US011692329B2

(12) United States Patent
Lim et al.

(10) Patent No.: US 11,692,329 B2
(45) Date of Patent: Jul. 4, 2023

(54) APPARATUS FOR CONTROLLING AND METHOD FOR CONTROLLING QUICK-CLAMPING OF CONSTRUCTION MACHINE

(71) Applicant: Doosan Infracore Co., Ltd., Incheon (KR)

(72) Inventors: Young Sup Lim, Suwon-si (KR); Jun Hong Park, Goyang-si (KR); Duck Woo Park, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 1022 days.

(21) Appl. No.: 16/478,308

(22) PCT Filed: Jan. 17, 2018

(86) PCT No.: PCT/KR2018/000798
§ 371 (c)(1),
(2) Date: Jul. 16, 2019

(87) PCT Pub. No.: WO2018/135854
PCT Pub. Date: Jul. 26, 2018

(65) Prior Publication Data

US 2019/0390437 A1 Dec. 26, 2019

(30) Foreign Application Priority Data

Jan. 17, 2017 (KR) ..... 10-2017-0008285

(51) Int. Cl.
*E02F 3/65* (2006.01)
*E02F 9/20* (2006.01)
(Continued)

(52) U.S. Cl.
CPC ..... *E02F 3/653* (2013.01); *E02F 9/2004* (2013.01); *E02F 9/24* (2013.01); *G08B 3/10* (2013.01)

(58) Field of Classification Search
CPC . E02F 9/24; E02F 3/653; E02F 3/3604; E02F 3/3609
See application file for complete search history.

(56) References Cited

U.S. PATENT DOCUMENTS 6,964,122 B2 * 11/2005 Cunningham ..... E02F 3/3663 37/468
9,132,855 B2 * 9/2015 Bertsch ..... E02F 9/2012
10,113,292 B2 10/2018 Yokota et al.
(Continued)

FOREIGN PATENT DOCUMENTS

JP 2008266975 A 11/2008
JP 2015-200104 A 11/2015
(Continued)

OTHER PUBLICATIONS

Chinese Office Action dated Dec. 9, 2020, in connection with corresponding Chinese Patent Application No. 201880007366.8, citing the above references.
(Continued)

*Primary Examiner* — Abiy Teka
(74) *Attorney, Agent, or Firm* — Hauptman Ham, LLP

(57) ABSTRACT

An embodiment of the present invention relates to an apparatus for controlling quick clamping of construction machine which comprises a clamp for mounting an attachment, the apparatus including: a selection input unit for generating a selection signal during an on operation by an operator; an operation input unit for generating an operation signal during an operation by the operator; a clamp driving unit for releasing and fastening the clamp; and a controller for controlling the clamp driving unit to release the clamp
(Continued)

while the operation signal is input after the selection signal is input.

13 Claims, 4 Drawing Sheets

(51) Int. Cl.
*E02F 9/24* (2006.01)
*G08B 3/10* (2006.01)

(56) References Cited

U.S. PATENT DOCUMENTS

| | | | | |
|---|---|---|---|---|
| 2008/0101908 | A1* | 5/2008 | Yao | E02F 3/3663 414/723 |
| 2011/0088795 | A1* | 4/2011 | Hill | E02F 9/226 137/557 |
| 2014/0030005 | A1 | 1/2014 | Friedrich | |
| 2016/0326712 | A1* | 11/2016 | Koestler | E02F 3/3631 |
| 2017/0030047 | A1* | 2/2017 | Yokota | E02F 3/32 |

FOREIGN PATENT DOCUMENTS

| | | | | |
|---|---|---|---|---|
| KR | 20-0319139 | Y1 | 7/2003 | |
| KR | 200319139 | Y1 * | 7/2003 | E02F 3/3663 |
| KR | 10-2015-0117480 | A | 10/2015 | |
| WO | 2012-156672 | A1 | 11/2012 | |
| WO | 2012156672 | A1 | 11/2012 | |

OTHER PUBLICATIONS

Japanese Office Action dated Oct. 6, 2020, in connection with the Japanese Patent Application No. 2019-538496 citing the above reference(s).

The Extended European Search Report for European Patent Application No. 18741897.5 (PCT/KR2018000798) dated Feb. 25, 2020, citing above references.

International Search Report dated Apr. 23, 2018, corresponding to International Application No. PCT/KR2018/000798 citing the above reference(s).

* cited by examiner

APPARATUS FOR CONTROLLING AND METHOD FOR CONTROLLING QUICK-CLAMPING OF CONSTRUCTION MACHINE

CROSS-REFERENCE TO RELATED APPLICATION

The present application is a national stage filing under 35 U.S.C § 371 of PCT application number PCT/KR2018/000798 filed on Jan. 17, 2018 which is based upon and claims the benefit of priority to Korean Patent Application No. 10-2017-0008285, filed on Jan. 17, 2017, in the Korean Intellectual Property Office, which is incorporated herein in its entirety by reference.

TECHNICAL FIELD

Embodiments of the present invention relate to an apparatus for controlling and a method for controlling quick clamping of construction machine.

DISCUSSION OF RELATED ART

In general, heavy machiney, e.g., excavators, used in construction site or civil engineering works are provided with various replaceable attachments for multiple uses, for example, digging the ground using a bucket, dismantling concrete buildings and cutting rebar using a crusher, breaking rock and concrete using a breaker, transporting scrap iron and rock using a grab, foundation works for a vertical shaft, water supply, and sewage system using a clamshell bucket.

The attachment is detachably coupled to an arm or a boom of the excavator to be replaceable according to the usage of the operation.

For conventional heavy machine, in order to facilitate the replacement of such attachments, quick clamping function for releasing a clamp of the attachment only by a switch input is applied FIG. 1 is an exemplary circuit diagram for performing a quick clamping function of conventional heavy machine.

As illustrated in FIG. 1, a machine control apparatus 2 activates a clamp solenoid valve 3 to perform a function of releasing an attachment, when a toggle switch 1 is switched on.

Such a quick clamping function allows easy replacement of attachments. However, there is a problem that an operator may operate the control apparatus unintentionally, leading to an accident that the attachment is released.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Embodiments of the present invention may be directed to an apparatus for controlling quick clamping of construction machine that may substantially prevent an accident that may occur when an operator operates the control apparatus unintentionally and the attachment is released.

In addition, embodiments of the present invention may further be directed to an apparatus for controlling quick clamping of construction machine that is realized by using a switch or an input button which is a conventionally provided element, instead of additionally providing a separate switch.

TECHNICAL SOLUTION TO THE PROBLEM

According to an embodiment, an apparatus for controlling quick clamping of construction machine which comprises a clamp for mounting an attachment includes: a selection input unit for generating a selection signal during an on operation by an operator; an operation input unit for generating an operation signal during an operation by the operator; a clamp driving unit for releasing and fastening the clamp; and a controllercontroller for controlling the clamp driving unit to release the clamp while the operation signal is input after the selection signal is input.

The operation input unit may generate the operation signal while the operator holds a pressing operation, and the controllercontroller may control the clamp driving unit so that the clamp is in a released state while input of the operation signal continues.

The operation input unit may include a plurality of operation input units so that the operator operates the operation input unit using both hands simultaneously.

The operation input unit may include one of a plurality of operation buttons and switches provided at a left joystick, and one of a plurality of operation buttons and switches provided at a right joystick.

When the pressing operation on one of the plurality of operation input units is stopped, the controllercontroller may control the clamp driving unit to fasten the clamp.

The apparatus may further include an output unit for outputting at least one of an alarm message and a warning sound. When the controller receives the selection signal, the controller may control the output unit to output at least one of the alarm message and the alarm sound.

When the selection input unit is switched off and generation of the selection signal is stopped, the controller may control the output unit to stop outputting the warning sound.

When the selection input unit is switched off and generation of the selection signal is stopped, the controller may activate a specific function mode controlled by the signal generated from the operation input unit. When the selection input unit is switched on and the selection signal is input, the controller may deactivate the specific function mode controlled by the signal generated from the operation input unit.

The operation input unit may include one of a plurality of operation buttons and switches provided at a left joystick and one of a plurality of operation buttons and switches provided at a right joystick, and require simultaneous operation of both hands of the operator.

The specific function of the selected operation button of the left joystick may be an engine deceleration selection signal output, and the specific function of the selected operation button of the right joystick may be a pressure-up selection signal output.

The controller may monitor input of a pilot cutoff signal, and controls the clamp driving unit so that the clamp is released only when the pilot cutoff signal is not input.

According to an embodiment, a method of controlling quick clamping of construction machine which comprises a clamp for mounting an attachment includes: a selection signal being input to a controller, the selection signal generated when an operator switches on a selection input unit;

an operation signal being input to the controller, the operation signal generated when the operator presses an operation input unit; and a controller controlling the clamp to be released while the operation signal is input after the selection signal is input.

EFFECTS OF THE INVENTION

According to one or more embodiments of the present invention, an apparatus for controlling quick clamping of construction machine may substantially prevent an accident that may occur when a clamp release function is activated without the intention of the driver and the attachment is detached.

DETAILED DESCRIPTION

Figure 1:
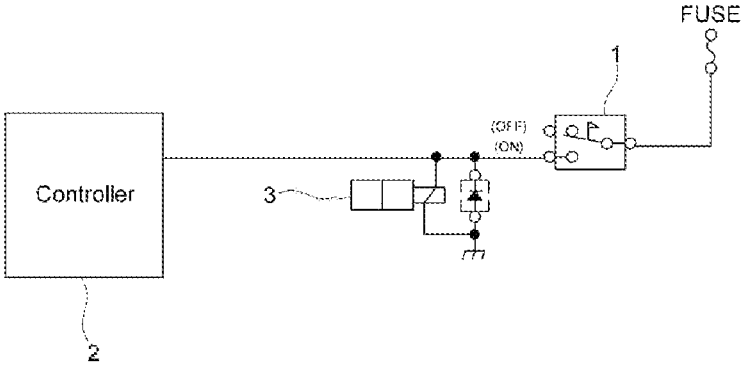
FIG. 1 is an exemplary circuit diagram for performing a quick clamping function of conventional heavy machine.

Embodiments will now be described more fully hereinafter with reference to the accompanying drawings. Although the invention may be modified in various manners and have several embodiments, embodiments are illustrated in the accompanying drawings and will be mainly described in the specification. However, the scope of the present invention is not limited to the embodiments and should be construed as including all the changes, equivalents and substitutions included in the spirit and scope of the present invention. It is noted that the technical terms used herein are used only to describe specific embodiments and are not intended to limit the invention. It is also to be understood that the technical terms used herein are to be interpreted in a sense generally understood by a person skilled in the art to which the present invention belongs, and should not be construed to mean, or be interpreted in an excessively reduced sense. Further, when a technical term used herein is an erroneous technical term that does not accurately express the spirit of the present invention, it can be replaced with the technical terms that can be understood by a person skilled in the art. In addition, the general terms used in the present invention should be interpreted according to a predefined or prior context, and should not be construed as being excessively reduced.

Throughout the specification, the singular forms "a", "an" and "the" include plural referents unless the context clearly dictates otherwise. It will be understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

Further, the suffixes "module," "part," "portion," and "unit" for components used in the present specification are given or mixed in consideration of ease of specification, and do not have their own meaning or role.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

Hereinafter, exemplary embodiments of the present invention will be described in detail with reference to the accompanying drawings, where like reference numerals refer to like or similar elements throughout the several views, and redundant description thereof will be omitted.

In the following description, well-known functions or configurations are not described in detail since they would obscure the invention in unnecessary detail.

It is to be noted that the accompanying drawings are only for the purpose of facilitating understanding of the present invention, and should not be construed as limiting the scope of the present invention with reference to the accompanying drawings.

Figure 2:
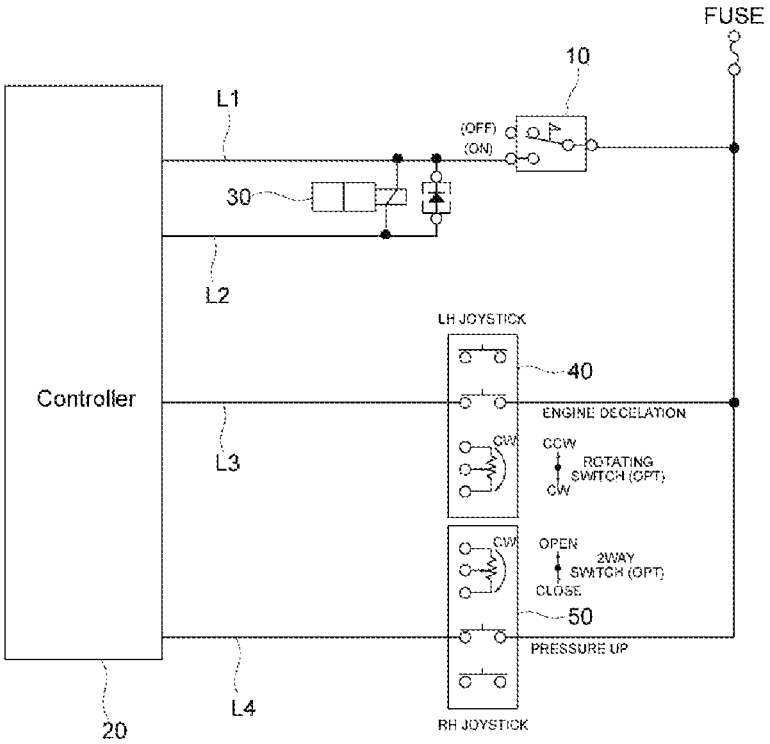
FIG. 2 is an exemplary circuit diagram for safe clamp operation according to an embodiment.

FIG. 2 is an exemplary circuit diagram for safe clamp operation according to an embodiment.

An apparatus for controlling quick clamping according to an embodiment may include a selection input unit 10, a controller 20, a clamp driving unit 30, and operation input units 40 and 50.

The clamp driving unit 30 may include a clamp valve that is connected to a clamp driving unit, e.g., a hydraulic cylinder, to control the supply of a working fluid to the clamp driving unit.

The controller 20 may control the operation of the clamp by controlling the clamp driving unit 30.

The selection input unit 10 is an input device for an operator to select a clamp operation. When the operator operates the selection input unit 10 to select the clamp operation, the selection input unit 10 generates a selection signal and transmits it to the controller 20.

The operation input units 40 and 50, separately from the selection input unit 10, are provided in a driver's cabin, and when operated by the operator, they generate an operation signal to be transmitted to the controller 20. As described above, when the operation signal is input after the selection signal generated by operation of the operator is input, the controller 20 may control the clamp driving unit 30 so that a clamp may be operated to maintain a release state while the operation signal is input.

In an embodiment illustrated in FIG. 2, the clamp driving unit 30 is provided in the form of a solenoid valve. The selection input unit 10 is provided in the form of a toggle switch that may be switched on and off by one-touch operation of the operator, and when an on state is selected, the selection input unit 10 may maintain a state where a clamp release driving is selected. The operation input units 40 and 50 are provided as an operational device in the form of at least two buttons, and may transmit the operation signal to the controller 20 while the operation input units 40 and 50 are operated by the operator. The operation input units 40 and 50 according to the present embodiment may generate the operation signal by a pressing operation, and may transmit the operation signal to the controller 20 while the operator presses the operation input unit 40 and 50. Accordingly, when the operator stops operation of any one of the operation input units 40 and 50, the controller 20 may control the clamp driving unit 30 to switch the clamp from the released state to a fastened state.

The selection input unit 10 and the operation input units 40 and 50 may be provided in the form of an electrostatic input device provided separately on an instrument panel screen or a control box. Although the controller 20 according to the present embodiment is provided in the form of a machine control device for controlling the operation of the construction machine, the controller 20 may be configured to perform its function at a separate control device provided in an electrical equipment such as an instrument panel.

The apparatus for controlling quick clamping according to an embodiment connects the controller 20 to the selection input unit 10, the clamp driving unit 30, and the operation input units 40 and 50 through a first signal line L1, a second signal line L2, a third signal line L3, a fourth signal line L4. The first signal line L1 connects the selection input unit 10 and the controller 20. The second signal line L2 connects the clamp driving unit 30 and the controller 20. The third signal line L3 and the fourth signal line L4 connect the operation input units 40 and 50 and the controller 20, respectively. The first signal line L1 and the second signal line L2 are connected to each other through the clamp valve 30. When a clamp release driving signal is output from the controller 20 to the second signal line L2 after the operator operates the selection input unit 10 and a clamp release mode is selected, the clamp driving unit 30 is operated to perform a clamp release operation. The above-described clamp release driving signal may be output from the controller 20 only when the operation input units 40 and 50 are further operated and the operation signal is input to the third signal line L3 and the fourth signal line L4. That is, the clamp valve 30 may not be operated only by the operation of the selection input unit 10 by the operator. This is to prevent the clamp from being released even though the selection input unit 10 is operated by the operator by mistake. In an embodiment, the controller 20 may be connected to an output unit (not illustrated) through a separate signal line (not illustrated) and may output at least one of a warning sound and a warning display through the output unit when the selection input unit 10 is switched on. This may help the operator to recognize that the clamp release driving is currently selected.

The operation input units 40 and 50 in the present embodiment may be installed at a joystick provided in a driver's cabin of the construction machine. The joystick is for operating a working device of the construction machine, e.g., a boom, an arm, and a bucket. In the case of an excavator, for example, two joysticks are respectively installed on the left and right sides of the driver's cabin. Such a joystick includes a plurality of operation buttons or switches so that additional functions may be performed in addition to the driving operation of the working device. When each of the operation buttons or switches is operated, it may individually operate a predetermined specific function. For example, the left joystick may include a plurality of operation buttons or switches including an engine deceleration selection operation button for forcing engine deceleration and a rotation operation switch for adjusting rotation of a rotatable optional working device. In addition, the right joystick may include a plurality of operation buttons or switches including a rotary switch for operating two-way optional working device and a pressure-up operation button for temporarily increasing a relief pressure of a hydraulic system of the construction machine. In the present embodiment, the operation input units 40 and 50 may be configured as one of the operation buttons of the left joystick and one of the operation buttons of the right joystick.

FIG. 2 shows an embodiment in which the operation input units 40 and 50 are in the form of an operation button type, i.e., the engine deceleration selection operation button and the pressure-up operation button. When a clamp release mode is selected by the operation of the operator through the selection input unit 10, the corresponding operation buttons are involved in the clamp release driving, instead of specific functions thereof. That is, a specific function mode in which the specific function is performed when the operation buttons are operated is cancelled. To this end, when the operation signal is applied by operating the operation buttons, the controller 20 recognizes the operation signal as a driving signal for driving the clamp when the selection input unit 10 is switched on; and recognizes it as a driving signal for performing the specific function of each operation button when the selection input unit 10 is switched off. In a specific function mode, in a case where the engine deceleration selection operation button and the pressure-up operation button are used as the operation input unit as in the present embodiment, an engine deceleration selection signal is output when the engine deceleration selection operation button is operated by the operator, and a pressure-up selection signal is output when the pressure-up operation button is operated by the operator.

As described above, since the operation input units 40 and 50 are provided as the operation buttons at the left and right joysticks, the operator may proceed with the clamp release operation only when both hands are simultaneously used. Accordingly, it is possible to suppress the occurrence of a safety accident because the possibility of the operator erroneously using both hands at the same time is low. In addition, the operation input units 40 and 50 may be configured to generate a driving signal while the operator is performing a pressing operation. That is, the operation input units 40 and 50 should be held in a pressing operation state while the clamp release driving proceeds. This also improves the effects of preventing the safety accident caused by the operator's mistake. On the other hand, when the operator desires a clamp release operation, both of the operation input units 40 and 50 respectively disposed at the left and right joysticks may be easily operated by two hands.

Figure 3:
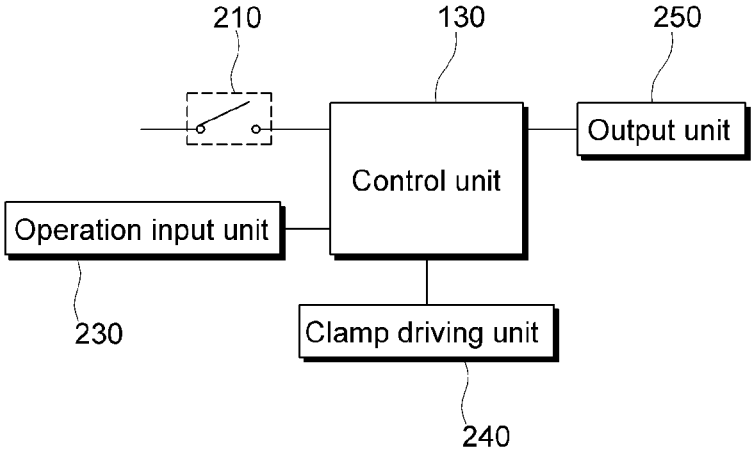
FIG. 3 is a schematic block diagram illustrating an apparatus for controlling quick clamping of construction machine according to an embodiment.

FIG. 3 is a schematic block diagram illustrating an apparatus for controlling quick clamping of construction machine according to an embodiment.

As illustrated in FIG. 3, an apparatus for controlling quick clamping according to an embodiment may include a selection input unit 210, a controller 220, an operation input unit 230, a clamp driving unit 240, and an output unit 250.

When switched on, the selection input unit 210 generates a signal for releasing the clamp.

The signal generated when the selection input unit 210 is switched on or off is transmitted to the controller 220.

The controller 220 controls each component so that an operation safety device may secure the safety of the operation. When an on signal is input from the selection input unit 210 and a signal from the operation input unit 230 is generated, the controller 220 controls so that clamping of the attachment is released.

The operation input unit 230 generates a predetermined signal by operator's operation. The generated signal is transmitted to the controller 220.

The operation input unit 230 may include one or more of any buttons or switches provided at the construction machine, such as a button on the left joystick, a button on the right joystick, or any button on the instrument panel.

The output unit 250 may visually display an alarm or notify the alarm audibly in accordance with an instruction from the controller 220.

The output unit 250 may include at least one of a display device, e.g., an instrument panel, and a speaker.

When the controller 220 receives the signal generated by turning on the selection input unit 210, the controller 220 deactivates the specific function mode matched with the signal generated by the operation input unit 230, and determines it as an additional input signal for releasing the clamp. As used herein, the specific function mode is a mode for performing a specific function which is set according to the signal of the operation input unit 230. As used herein, the specific functions are the same as those described above, and a detailed description thereof will be omitted.

At the same time, when the controller 220 receives the signal generated by turning on the selection input unit 210, the controller 220 outputs an alarm to notify the operator that the selection input unit 210 is switched on.

In a state in which the selection input unit 210 is switched on, that is, in a state in which the specific function mode of the operation input unit 230 is deactivated, the controller 220 recognizes the signal generated by the operation input unit 230 as an operation signal for the operator to release the clamp.

Accordingly, when the controller 220 receives the signal generated by the operation input unit 230 in a state where the selection input unit 210 is switched on, the controller 220 controls the clamp to be released.

Figure 4:
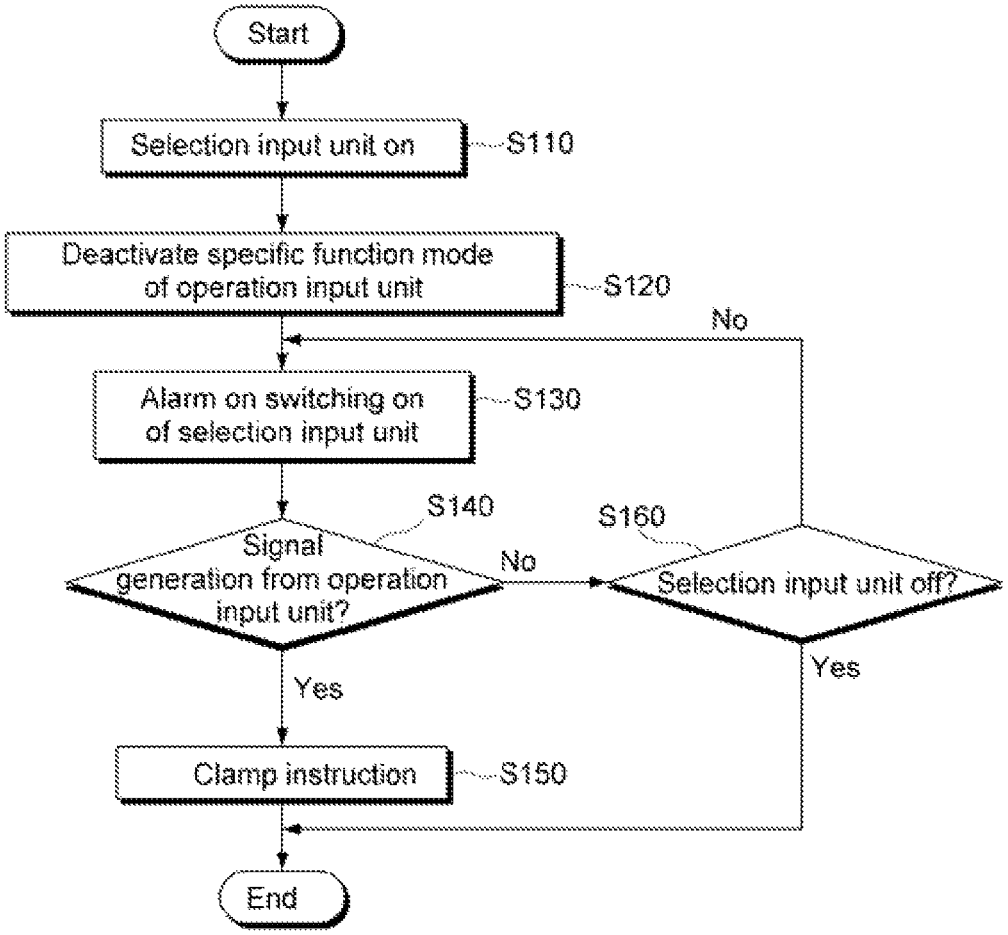
FIG. 4 is a view illustrating a method for controlling quick clamping of construction machine according to an embodiment.
Figure 5:
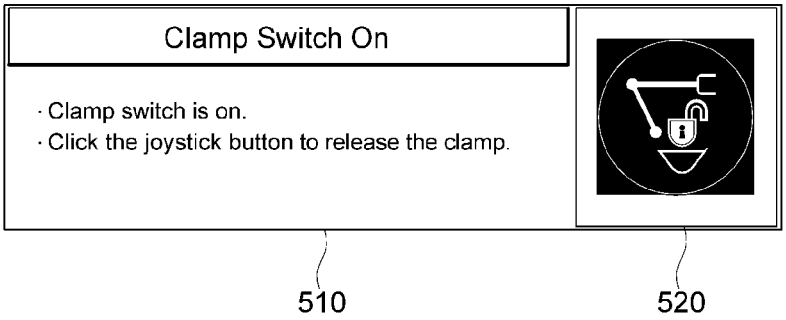
FIG. 5 is a view illustrating an example of an alarm display displayed on an output unit according to an embodiment.

FIG. 4 is a view illustrating a method for controlling quick clamping of construction machine according to an embodiment, and FIG. 5 is a view illustrating an example of an alarm display displayed on an output unit according to an embodiment.

Prior to the description, it is assumed that both of the left button and the right button of the joystick are used as an input unit in the present embodiment.

Referring to FIG. 4, first, the selection input unit is switched on (S110), and a signal generated by a switch-on switching is transmitted to the controller.

The controller deactivates the specific function mode of the input unit (S120).

At the same time, the controller informs the operator that the selection input unit has been switched on, so that the operator may recognize it (S130).

The above-mentioned notification may be made through a warning sound. When the selection input unit is switched on, the controller may control a sound device in the driver's cab, for example, a speaker, a pilot buzzer, etc. so that a beep sound may be output in the driver's cab. This warning sound may continue until the selection input unit is switched off.

In addition, as illustrated in FIG. 5, a text 510 indicating that the selection input unit is switched on and a symbol 502 indicating that the selection input unit is switched on may be displayed on the display device such as the instrument panel of the construction machine. The display text may be output on the display device in a pop-up format.

This display text may be set to disappear automatically when the selection input unit is switched off again or when the operation input unit (the left joystick button and the right joystick button in the present embodiment) is operated and the clamp is released.

Referring again to FIG. 4, it is monitored whether a signal is generated from the left joystick button and the right joystick button (S140).

If the signal generated from the left joystick button and the right joystick button is input to the controller in step S140, the controller determines that the operator desires to release clamping and instructs the release of clamping of the attachment (S150).

If no signal is generated from either the left joystick button or the right joystick button in step S140, the controller determines that the operator does not want the release of clamping and confirms whether the clamp is switched off (S160).

If the selection input unit is not switched off in step S160, the process returns to step S120 to notify that the selection input unit is in the on state.

In another modified embodiment, monitoring whether a pilot cutoff signal is input may be added prior to step S110.

If the pilot cutoff signal is not input, operation of the machine is stopped, and the process may then proceed to a clamp safe operation step (after step S110) only when the pilot cutoff signal is not input.

In other words, since the working device is in operation if the pilot cutoff signal is input, the clamp release function is not performed even though the clamp is switched on.

The apparatus for controlling quick clamping according to an embodiment may substantially prevent a safety accident that may occur when an operator operates the control apparatus unintentionally and the attachment is released.

It will be understood by those skilled in the art that the foregoing description of the present invention is for illustrative purposes only and that those of ordinary skill in the art may readily understand that various changes and modifications may be made without departing from the spirit or essential characteristics of the present invention. It is therefore to be understood that the above-described embodiments are illustrative in all aspects and not restrictive. For example, each component described as a single entity may be distributed and implemented, and components described as being distributed may also be implemented in a combined form.

While the present invention has been particularly shown and described with reference to exemplary embodiments thereof, although specific terms have been employed, they have been used in a generic sense only to facilitate the description of the subject matter of the specification and to aid the understanding of the invention, and it is not intended to limit the scope of the specification. It will be apparent to those skilled in the art that other modifications based on the technical idea of the present invention are possible in addition to the embodiments disclosed herein.

INDUSTRIAL APPLICABILITY

The invention disclosed herein is industrially applicable since it can promote sales of the construction machine applied with the relevant technology and it is clearly described to be practically possible to carry out, by including a structure for generating a warning sound unless both hands of the operator are in continuous operation during the operation of a quick coupler, thus improving convenience and safety at the same time.

The invention claimed is:

1. An apparatus for controlling quick clamping of construction machine which comprises a clamp for mounting an attachment, the apparatus comprising:

a selection input unit for generating a selection signal during an operation by an operator;

an operation input unit for generating an operation signal during a pressing operation by the operator;

a clamp driving unit for releasing and fastening the clamp; and a controller for controlling the clamp driving unit to release the clamp while the operation signal is input after the selection signal is input, wherein the operation input unit is configured to generate the operation signal while the operator holds the pressing operation, the controller is configured to control the clamp driving unit so that the clamp is in a released state while input of the operation signal continues, and the operation input unit includes a plurality of operation input units configured to be simultaneously operated by both hands of the operator.

2. The apparatus of claim 1, wherein the operation input unit comprises a left joystick including one of a plurality of operation buttons or switches, and a right joystick including one of a plurality of operation buttons or switches.

3. The apparatus of claim 2, wherein in response to the pressing operation on one of the plurality of operation input units being stopped, the controller is configured to control the clamp driving unit to fasten the clamp.

4. The apparatus of claim 1, further comprising an output unit for outputting at least one of an alarm message or a warning sound, wherein in response to the controller receiving the selection signal, the controller is configured to control the output unit to output at least one of the alarm message or the warning sound.

5. The apparatus of claim 4, wherein in response to the selection input unit being switched off and generation of the selection signal being stopped, the controller is configured to control the output unit to stop outputting the warning sound.

6. The apparatus of claim 1, wherein the controller is configured to monitor input of a pilot cutoff signal, and control the clamp driving unit so that the clamp is released only when the pilot cutoff signal is not input.

7. An apparatus for controlling quick clamping of construction machine which comprises a clamp for mounting an attachment, the apparatus comprising:

a selection input unit for generating a selection signal during a first operation by an operator;

an operation input unit for generating an operation signal during a second operation by the operator;

a clamp driving unit for releasing and fastening the clamp; and a controller for controlling the clamp driving unit to release the clamp while the operation signal is input after the selection signal is input, wherein in response to the selection input unit being switched off and generation of the selection signal being stopped, the controller is configured to activate a specific function mode controlled by the operation signal generated from the operation input unit; and in response to the selection input unit being switched on and the selection signal being input, the controller is configured to deactivate the specific function mode controlled by the operation signal generated from the operation input unit.

8. The apparatus of claim 7, wherein the operation input unit comprises a left joystick including one of a plurality of operation buttons or switches and a right joystick including one of a plurality of operation buttons or switches and the operation input unit is configured to be simultaneously operated by both hands of the operator.

9. The apparatus of claim 8, wherein when the specific function mode is activated, one of the plurality of operation buttons or switches at the left joystick is associated with an engine deceleration selection signal output, and one of the plurality of operation buttons or switches at the right joystick is associated with a pressure-up selection signal output.

10. A method of controlling quick clamping of construction machine which comprises a clamp for mounting an attachment, the method comprising:

a selection signal being input to a controller, the selection signal generated when an operator switches on a selection input unit;

an operation signal being input to the controller, the operation signal generated when the operator presses an operation input unit; and a controller controlling the clamp to be released while the operation signal is input after the selection signal is input, wherein the operation input unit generates the operation signal while the operator holds a pressing operation, the controller controls the clamp driving unit so that the clamp is in a released state while input of the operation signal continues, and the operation input unit includes a plurality of operation input units which are simultaneously operated by both hands of the operator.

11. The method of claim 10, wherein the operation input unit comprises a left joystick including one of a plurality of operation buttons or switches and a right joystick including one of a plurality of operation buttons or switches.

12. The method of claim 10, wherein the controller deactivates a specific function mode, controlled by the operation signal output from the operation input unit, after the selection signal is input, and the controller activates the specific function mode of the operation input unit when generation of the selection signal is stopped by switching off the selection input unit.

13. The method of claim 10, wherein the controller controls an output unit to output at least one of an alarm message or an alarm sound after the selection signal is input, and outputting of at least one of the alarm message or the alarm sound is stopped when the operator switches off the selection input unit.

* * * * *